US006014788A

United States Patent [19]

Jaffri

[11] Patent Number: 6,014,788

[45] Date of Patent: Jan. 18, 2000

[54] LINT ROLLER

[75] Inventor: Rubina Jaffri, P.O. Box 182004, Shelby, Mich. 48318

[73] Assignee: Rubina Jaffri, Shelby, Mich.

[21] Appl. No.: 08/922,658

[22] Filed: Sep. 3, 1997

[51] Int. Cl.[7] ..... A47L 13/10

[52] U.S. Cl. ..... 15/104.002; 15/230.11; 492/13; 492/19; 428/43

[58] Field of Search ..... 15/104.002, 230.11; 492/13, 19; 428/43, 906

[56] References Cited

U.S. PATENT DOCUMENTS

| | | | |
|---|---|---|---|
| D. 320,680 | 10/1991 | Stetson . | |
| D. 342,610 | 12/1993 | Stetson . | |
| 3,056,154 | 10/1962 | Neal | 15/104.002 |
| 3,158,887 | 12/1964 | Kanbar et al. | 15/104.002 |
| 3,299,461 | 1/1967 | Marks | 15/104.002 |
| 3,373,457 | 3/1968 | Rouch, Jr. | 15/104.002 |
| 3,742,547 | 7/1973 | Sohmer | 15/104.002 |
| 4,399,579 | 8/1983 | McKay . | |
| 4,727,616 | 3/1988 | Kucera et al. | 15/105.002 |
| 5,027,465 | 7/1991 | McKay . | |

FOREIGN PATENT DOCUMENTS

| | | | |
|---|---|---|---|
| 6-217924 | 8/1994 | Japan | 15/104.002 |

*Primary Examiner*—Elizabeth McKane
*Attorney, Agent, or Firm*—Rader, Fishman & Grauer PLLC

[57] ABSTRACT

A large micro-debris roller having one sided adhesive sheets facing outward and wound up on a rotatable core. The core is supported by a symmetrical handle. Each adhesive sheet is provided with a non-adhesive tab which cooperates with perforations in the adhesive sheets to make possible the simple disposal of the adhesive sheets.

18 Claims, 5 Drawing Sheets

LINT ROLLER

FIELD OF INVENTION

This invention elates to a micro-debris remover. More particularly, the invention concerns a lint roller that has at least one non-adhesive gripping tab for selectively removing sheets of adhesive material from the lint roller.

BACKGROUND

Lint rollers are well known for use in removing micro-debris. In use, such lint rollers are typically coated with adhesive masking tape sheets wound around a cylindrical core which rotates. When the adhesive tape becomes contaminated with micro-debris, the contaminated adhesive sheet is then peeled off and discarded, readying a subsequent adhesive sheet for more use.

There are several known types and styles of lint rollers. Examples of such prior art devices are McKay, U.S. Pat. Nos. 5,027,465 and 4,399,579, Kucera, U.S. Pat. No. 4,727,616 and Stetson U.S. Pat. No. D342,610. With respect to the known prior art, the devices demonstrate many disadvantages. One such disadvantage is the manner of removing contaminated adhesive sheets. The known lint rollers provide for loosening the adhesive with a fingernail, and pulling down to separate the contaminated adhesive sheet. This presents an obstacle of successfully keeping the sheet in a whole form and therefore preventing the contaminated sheet from separating from itself.

Another disadvantage present in prior art lint rollers is the difficulty of removing a contaminated adhesive sheet and avoiding gripping other non-contaminated sheets which tend to stick to the contaminated sheet. Accidental gripping of non-contaminated sheets results in waste of the adhesive sheets and frustration to the user.

Further, known lint removers rollers are small in size. The disadvantages that occur due to the small size of such lint rollers are discomfort and considerable time to operate the lint roller when attempting to use these devices on a large area.

SUMMARY

The present invention describes a general cleaning tool which has a rotatable core which is covered by a large roll of clear adhesive tape wound successively around the core, with perforations being provided along the roll to separate the roll into sheets. Each of the sheets further incorporates a non-adhesive tab connected thereto to facilitate removal of the sheet. Further, the lint roller preferably includes perforations that extend both laterally and transversely across the tape so as to divide the sheets into smaller sheets with the tabs being disposed on each small sheet.

For those disadvantages which are mentioned in the preceding paragraphs, the present inventor has developed a device that eliminates the present problems of the prior art. First, by providing a non-adhesive gripping tab on every adhesive sheet, the inconvenience of using a fingernail to remove the adhesive sheet from the roll is eliminated. Providing a non-adhesive tab also eliminates the non-contaminated adhesive sheet from being discarded with contaminated adhesive sheets.

Preferably, the lint roller is sized to be larger than average lint rollers found in the prior art such that the present invention is a much quicker, faster and more effective way of cleaning.

Further objects and advantages of this present invention are to provide a simple cleaning device with no frustrations involved. Still further objects and advantages will become apparent from a consideration of the drawings and ensuing description.

DRAWING FIGURES

The features and inventive aspects of the present invention will become more apparent upon reading the following detailed description, claims, and drawings.

DETAILED DESCRIPTION

Figure 1:
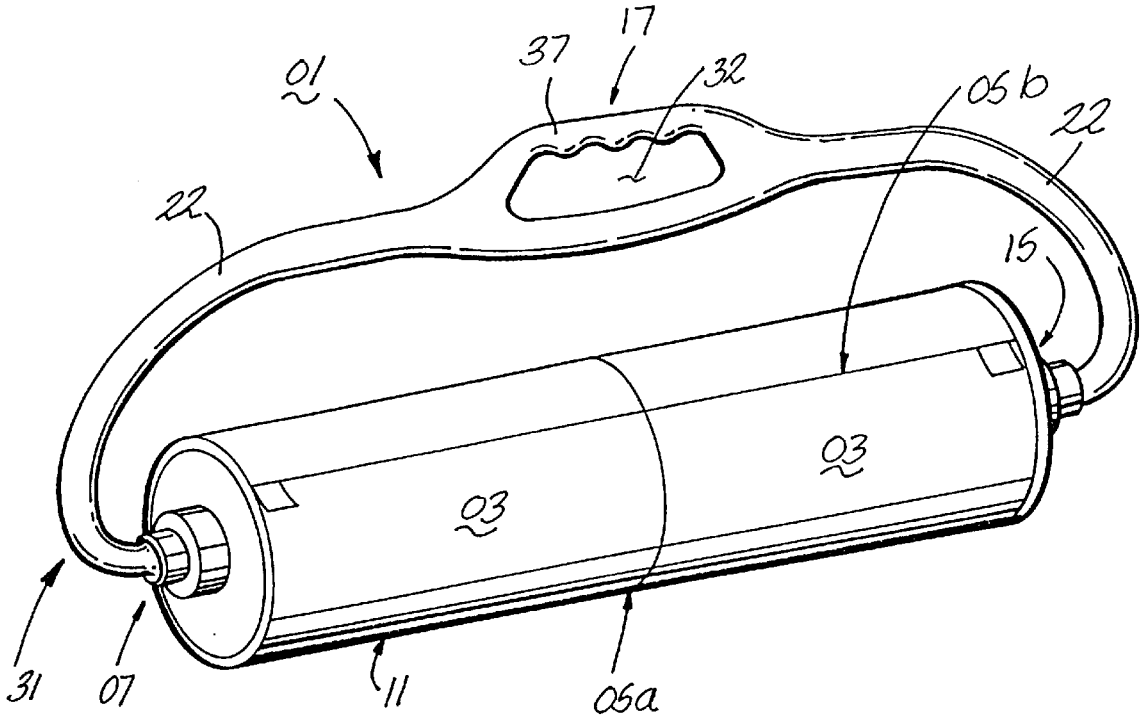
FIG. 1 is a perspective view of a preferred embodiment of a micro-debris lint roller.
Figure 2:
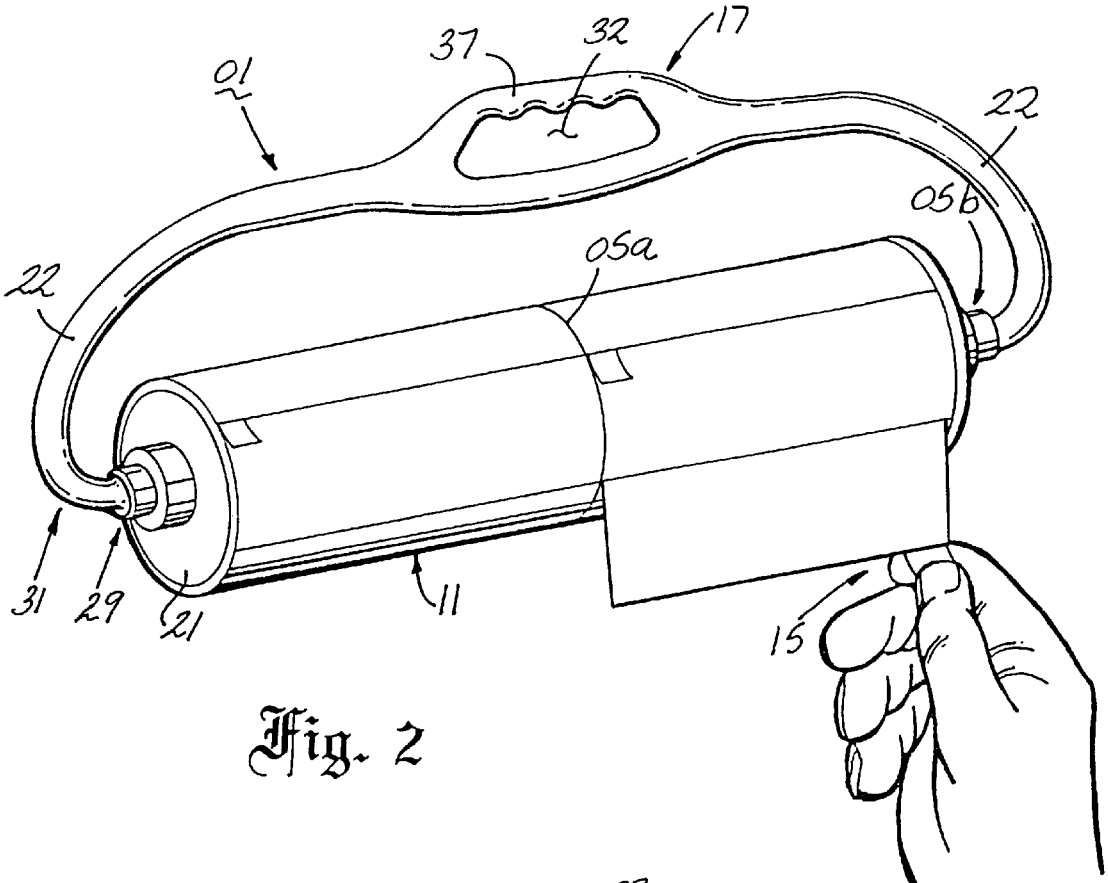
FIGS. 2–3 are perspective views of the preferred embodiment of the micro-debris lint roller demonstrating contaminated halves of an adhesive sheet being stripped away from non-contaminated adhesive sheets.
Figure 3:
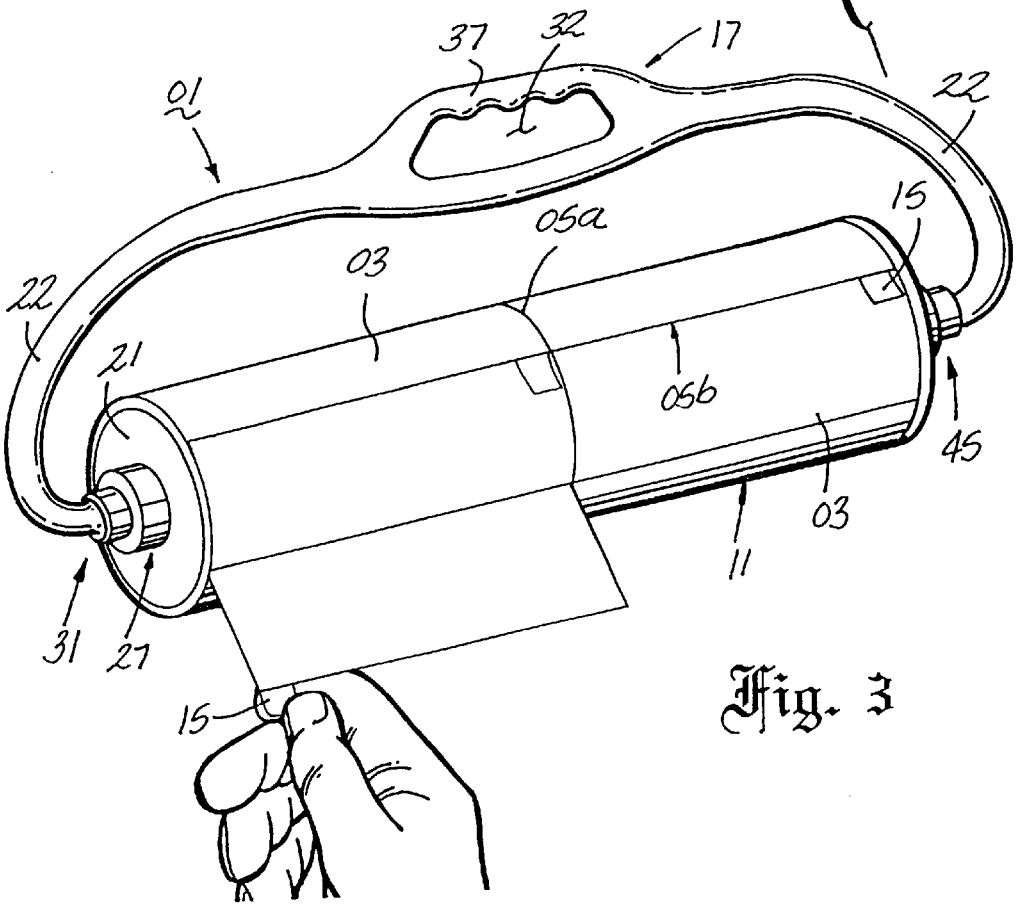
Figure 4:
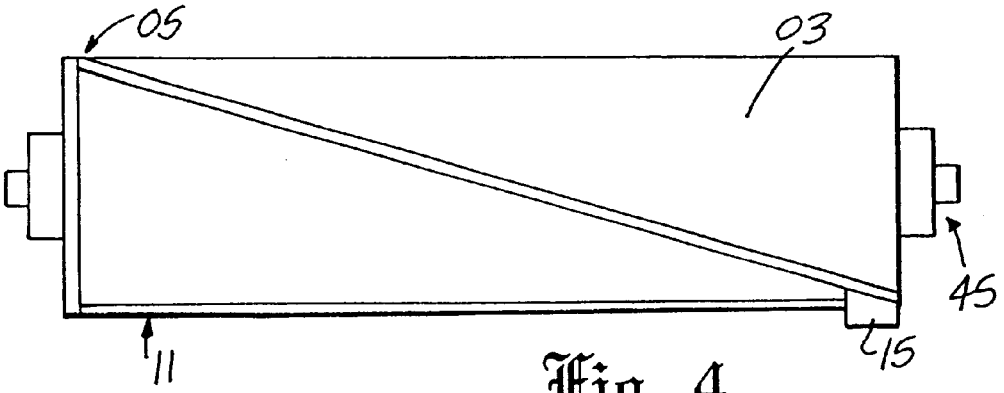
FIGS. 4–7 are elevational views of an adhesive roll showing possible perforation styles of the adhesive roll.
Figure 5:
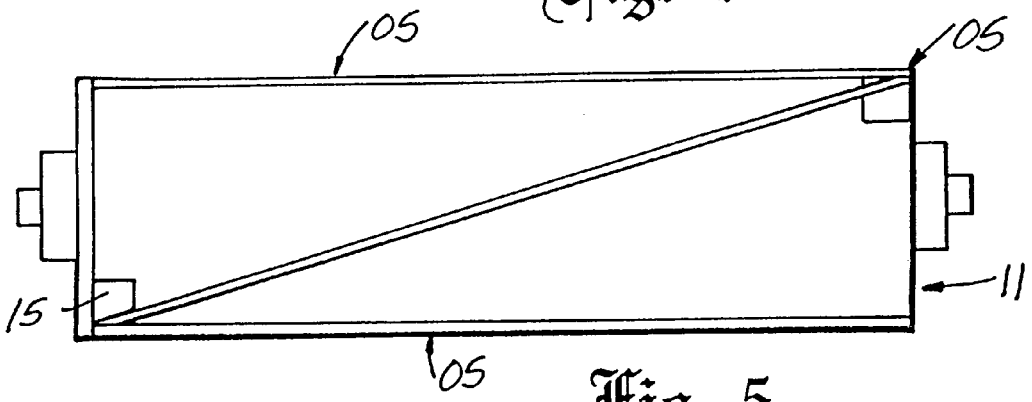
Figure 6:
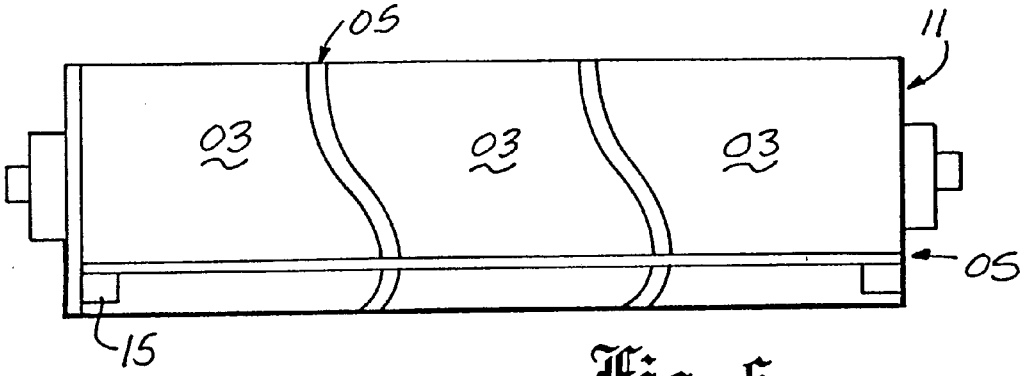
Figure 7:
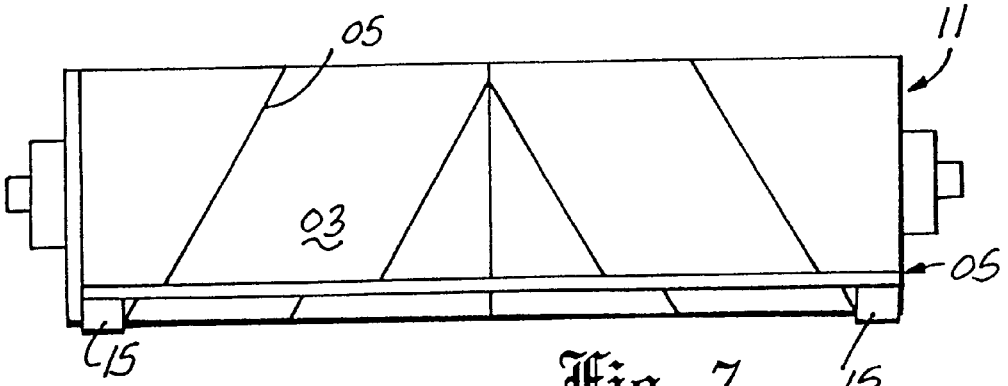
Figure 8:
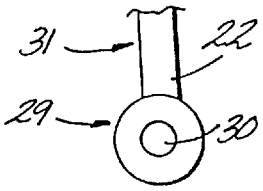
FIG. 8 is a side view of an arcuate handle.
Figure 9:
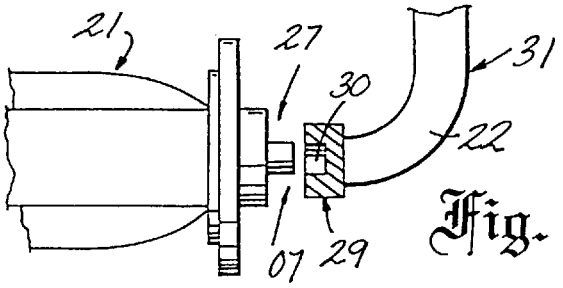
FIG. 9 is an end view of the micro-debris lint roller.

A typical embodiment of a lint roller 01 in accordance with the present invention is illustrated in FIG. 1. The roller 01 has an adhesive roll 11 of material, the material being wound successively to form roll 11, with roll 11 being supported by a rotatable core 21. Along adhesive roll 11 are perforations 05. Perforations 05 run vertically 05*a* and horizontally 05*b*, dividing adhesive roll 11 into sectioned sheets 03, as seen in FIGS. 1–3. Perforations 05 also aid in separating sectioned sheets 03 from roll 11. The addition of intersecting perforations allows the number of sheets 03 to be conserved. In other words, after use of roll 01, selective removal of only those sheets 03 that have become contaminated with micro-debris can be accomplished. Alternatively, perforations 05 may be provided in other orientations as shown in FIGS. 4–7. FIGS. 4–5 show lines of perforation 05 in a diagonal orientation across roll 11. FIG. 6 shows wave-like perforations 05 that divide roll 11 into a plurality of sheets 03. FIG. 7 illustrates a number of diagonal perforations 05 that divide roll 11 into a plurality of differing shaped sheets 03.

In accordance with another aspect of the invention, each adhesive sheet 03 is provided with a non-adhesive tab 15. The non-adhesive tab 15 is used as a grip in the process of discarding adhesive sheets that have been contaminated with micro-debris, as shown in FIGS. 2 and 3. Preferably, non-adhesive tab 15 is colored, so as to be easily visible. In use, non-adhesive tab 15 is pulled backward, tearing a sheet 03 from roll 11 due to perforations 05.

Figure 10:
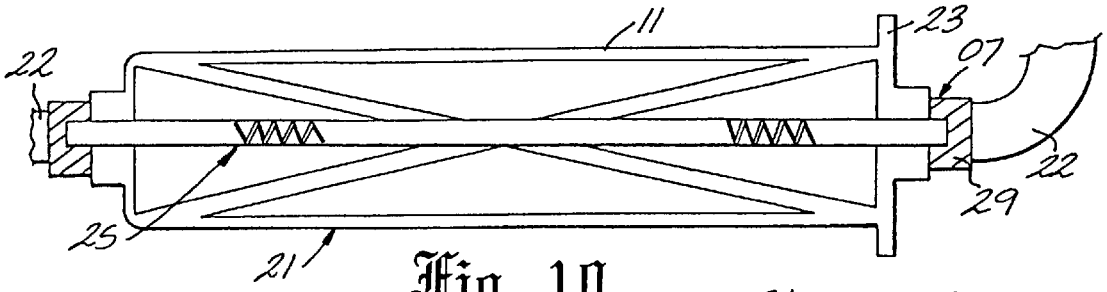
FIGS. 10–13 are cross-sectional views of the micro-debris lint roller showing alternative positions of a spring in a core.
Figure 11:
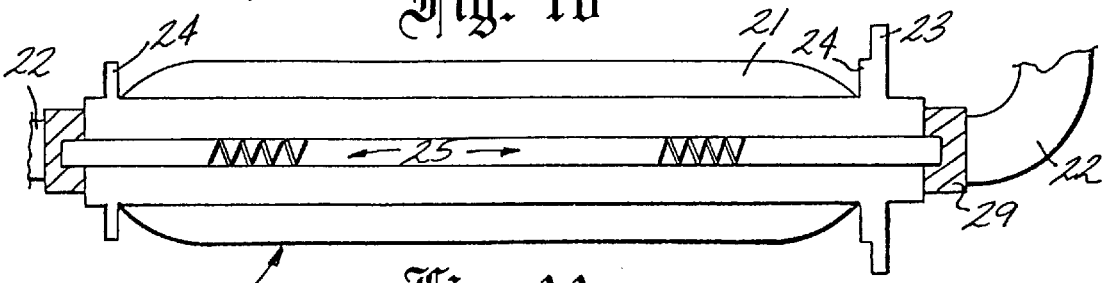
Figure 12:
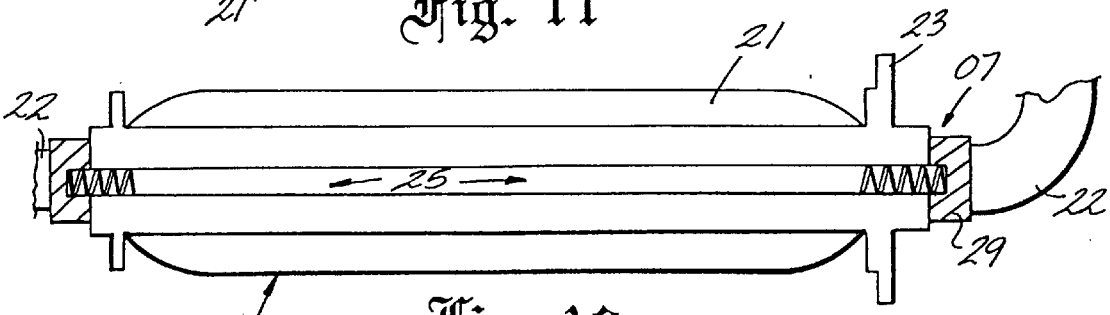
Figure 13:
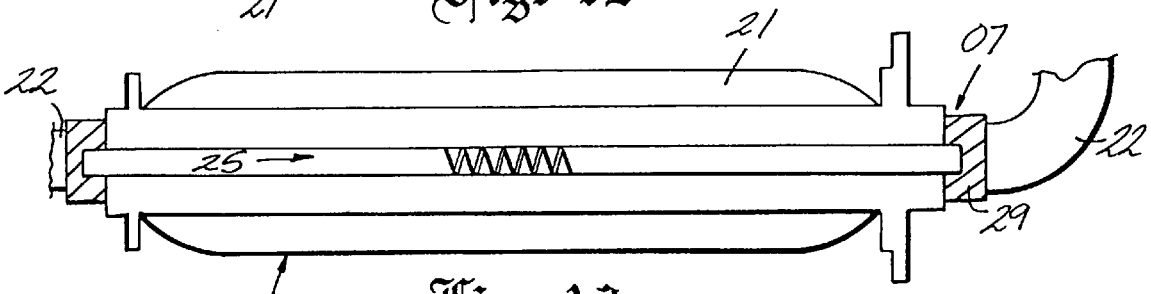

A frame 31 is also provided for supporting core 21. Frame 31 preferably has symmetrical arms 22 that connect to both sides of core 21 such that core 21 is rotatable. Arms 22 are each provided with a detachable end piece 29 that includes an aperture 30 that is adapted to receive a plug 07 from core 21, as shown in FIGS. 8–13. At least one spring 25 is disposed within the interior of core 11 to bias plugs 07 outward of core 11 and into engagement with aperture 30 in arms 22, thereby positioning core 11 within frame 31. FIGS. 10–12 show two spring configurations with springs 25 being located so as to be symmetrical with each other. Referring to FIG. 12, springs 25 serve as plugs 07 to engage aperture 30. FIG. 13 shows placing a single spring 25 at approximately the center of core 11.

As seen in FIGS. 10–13, core 21 also includes a stopper flange 23 and retainers 24, the retainers 24 serving to support roll 11 on core 21. Referring to FIG. 10, when roll 11 is placed onto core 21 and end of roll 11 comes into contact with stopper flange 23 to keep roll 11 from sliding off core 21. To insert or remove roll 11 from core 21, each detachable end piece 29 is first disengaged from each plug 07, such that plug 07 comes out of engagement with aperture 30, thereby removing frame 31. Roll 11 may then be slid laterally onto core 21 and engaging retainers 24, until contacting stopper flange 23. To remove roll 11, roll 11 must be slid away from stopper flange 23.

Figure 14:
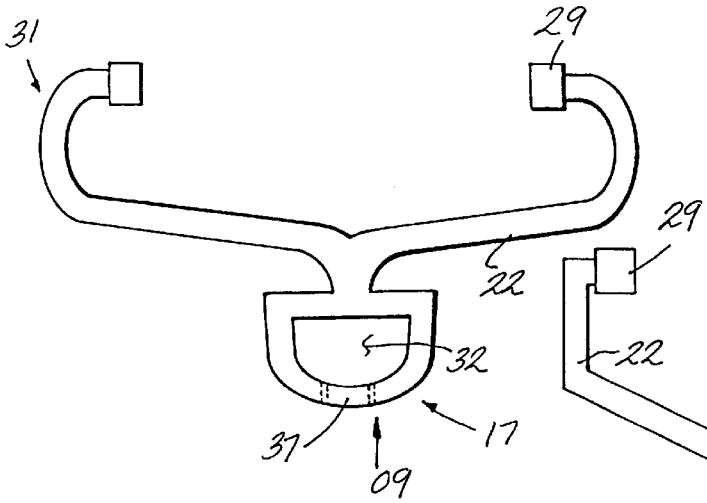
FIGS. 14–17 are possible handle styles for the micro-debris lint roller.
Figure 15:
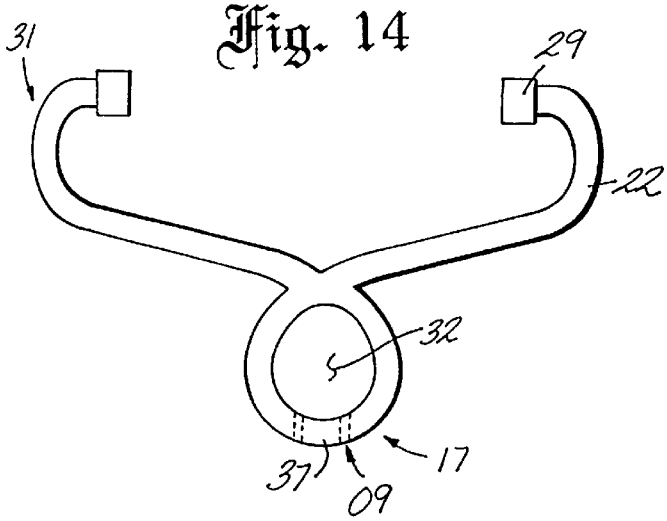
Figure 16:
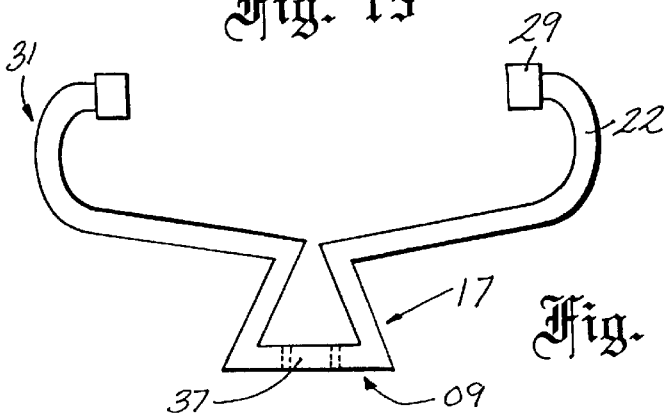
Figure 17:
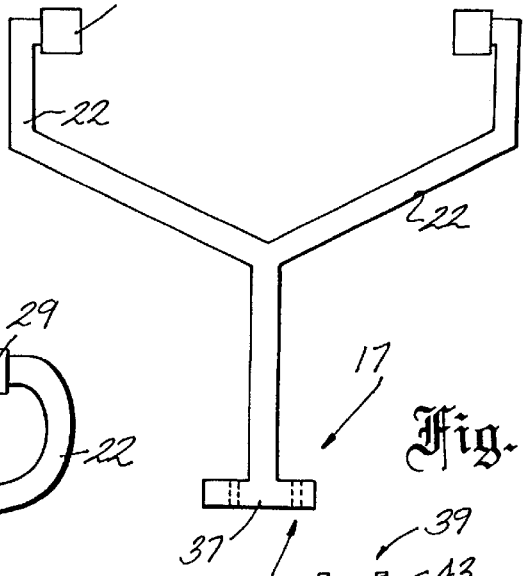

Frame 31 may be provided with a handle 17 as seen in FIGS. 1–3. In the preferred embodiment, handle 17 is integral with frame 31, and has an aperture 32 to form a grip 37 such that a hand can grasp handle 17 easily. FIGS. 14–17 illustrate alternative embodiments of frame 31 and handle 17. In FIG. 14, handle 17 is shown with grip 37 in the shape of a half moon. FIG. 15 shows handle 17 with a circular shaped grip 37. Grip 37 is shown triangular shaped in FIG. 16. A T-shaped grip 37 is illustrated in FIG. 17. It is understood, however, that the general shapes of frame 31 and handle 17 can vary, and therefore other configurations are within the scope of the invention.

Figure 18:
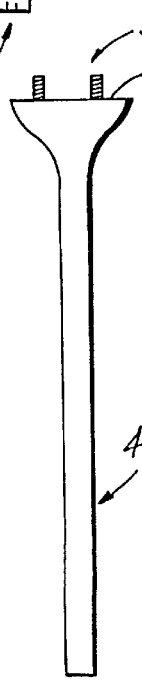
FIG. 18 is an optional pole which may be attached to the handle.

Referring to FIG. 18, an optional pole 41 may be provided. Pole 41 includes connectors 39 positioned at a distal end 43 of pole 41 for connecting with handle 17. Connectors 39 are receivable into mating recesses 09, shown in phantom in FIGS. 14–17, that are disposed in handle 17. In the preferred embodiment, connectors 39 are threaded such that simple twisting of pole 41 can attach or detach pole 41 to handle 17. Pole 41 enables roller 01 to be used in certain areas that are normally difficult to reach, such as ceilings.

In the preferred embodiment of the present invention, the preferred length of roll 11 is approximately 12 inches, so as to cover a large surface area relative to the prior art. However, the size of adhesive roll 11 are capable of varying from a smaller or larger size.

Roller 11 is preferably constructed of plastic, or any other suitable light weight material, thereby making it easy for a user to lift and operate.

Preferred embodiments of the present invention have been disclosed. A person of ordinary skill in the art would realize, however, that certain modifications would come within the teachings of this invention. Therefore, the following claims should be studied to determine the true scope and content of the invention.

I claim:

1. A lint roller, comprising:

a rotatable core;

at least one sheet of material disposed on said core, said sheet having a layer of adhesive disposed on one surface such that said adhesive is outwardly facing from said core; and at least one non-adhesive gripping tab extending outwardly away from an edge of each of said at least one sheet so as to permit selective removal of each of said at least one sheet from said core; wherein said gripping tab extends less than the entire length of said edge of said at least one sheet.

2. The lint roller of claim 1, further including a frame for supporting said core.

3. The lint roller of claim 2, wherein said frame further includes at least one arm adapted to selectively connect to said core and a handle, said handle having a gripping portion.

4. The lint roller of claim 3, wherein said frame includes two symmetrical arms, said arms adapted to connect to ends of said core such that said core is disposed between said arms.

5. The lint roller of claim 2, further including an extension pole adapted to attach to said frame.

6. The lint roller of claim 1, wherein said sheet of material is successively wound about said core so as to form a roll, said roll being selectively removable from said core.

7. The lint roller of claim 1, wherein said sheet further includes at least one perforation separating said sheet into sections, each of said sections further having at least one of said non-adhesive gripping tabs disposed on an edge of said section for selective removal of said sections at said perforation.

8. The lint roller of claim 7, wherein said perforation is oriented diagonally across said sheet.

9. The lint roller of claim 1, wherein said non-adhesive tab is colored.

10. The lint roller of claim 1, wherein said at least one sheet includes a plurality of sheets, wherein each of said plurality of sheets includes a non-adhesive gripping tab connected thereto so as to permit selective removal of each of said sheets from said core.

11. A lint roller, comprising:

a rotatable core;

a sheet of material wound successively around said core so as to form a roll, said sheet having a layer of adhesive disposed on one surface such that said adhesive is outwardly facing from said core; and a plurality of first perforations separating said sheet of material into sections; and a plurality of second perforations, wherein said second perforations bisect said first perforations to define sub-sections, each of said sub-sections being selectively removable from said roll.

12. The lint roller of claim 11, further including a non-adhesive gripping tab disposed on each of said sub-sections.

13. The lint roller of claim 12, wherein said non-adhesive tab is colored.

14. The lint roller of claim 11, wherein said first perforations extend laterally across said sheet and said second perforations extend transversely across said sheet.

15. The lint roller of claim 11, further including a frame having at least one arm adapted to connect to said core, said frame further including a handle having a gripping portion.

16. The lint roller of claim 15, wherein said frame includes two symmetrical arms, said arms adapted to connect to ends of said core such that said core is disposed between said arms.

17. The lint roller of claim 15, further including an extension pole adapted to attach to said frame.

18. A lint roller, comprising:

a rotatable core;

a sheet of material wound successively around said core so as to form a roll, said sheet having a layer of adhesive disposed on one surface such that said adhesive is outwardly facing from said core;

a plurality of first perforations separating said sheet of material into sections;

a plurality of second perforations, wherein said second perforations bisect said first perforations to define sub-sections wherein each of said sub-sections are selectively removable from said roll;

a non-adhesive gripping tab disposed on each of said sub-sections to facilitate selective removal of said sub-sections; and a frame for supporting said core, said frame further including a handle.

* * * * *

UNITED STATES PATENT AND TRADEMARK OFFICE

CERTIFICATE OF CORRECTION

PATENT NO. : 6,014,788

DATED : January 18, 2000

INVENTOR(S) : Rubina Jaffri

It is certified that error appears in the above-identified patent and that said Letters Patent is hereby corrected as shown below:

Column 1, line 4, change "elates" to read--relates--.

Signed and Sealed this

Eighth Day of August, 2000

*Attest:*

*Attesting Officer*

Q. TODD DICKINSON

*Director of Patents and Trademarks*